US005809578A

United States Patent [19]

Williams

[11] Patent Number: 5,809,578

[45] Date of Patent: Sep. 22, 1998

[54] ADJUSTABLE HELMET STRAPPING DEVICE

[76] Inventor: Heather S. Williams, 13620 SW. Beef Bend Rd. #97, Tigard, Oreg. 97224

[21] Appl. No.: 698,859

[22] Filed: Aug. 16, 1996

[51] Int. Cl.[6] ..... A42B 3/08

[52] U.S. Cl. ..... 2/421

[58] Field of Search ..... 2/410, 421, 422, 2/425, 411, 424

[56] References Cited

U.S. PATENT DOCUMENTS

| | | | |
|---|---|---|---|
| 532,567 | 1/1895 | Larwood, Jr. | 2/425 |
| 2,846,683 | 8/1958 | Dye et al. | 2/421 |
| 3,166,761 | 1/1965 | Strohm | 2/421 |
| 4,646,368 | 3/1987 | Infusino et al. | 2/421 |
| 4,741,054 | 5/1988 | Mattes | 2/421 |
| 4,766,610 | 8/1988 | Mattes | 2/425 |
| 5,083,321 | 1/1992 | Davidsson | 2/421 |
| 5,123,121 | 6/1992 | Broersma | 2/421 |
| 5,347,660 | 9/1994 | Zide et al. | 2/421 |

FOREIGN PATENT DOCUMENTS

| | | | |
|---|---|---|---|
| 2240255 | 7/1991 | United Kingdom | 2/421 |

*Primary Examiner*—Michael A. Neas

[57] ABSTRACT

An improved strapping apparatus used to fasten and secure the bicycle-style helmet to the head. Adjustable helmet strapping device is made using, nylon strapping, velcro fasteners, elastic, chin guard, vinyl pocket, and a series of D-rings which result in a very easy to use adjustable helmet strap. By using the combination listed above, this strapping device enables several advantages over current market adjustable helmet strapping systems. Some of which include: Use of D-Rings make adjusting between adult and child sizes extremely easy by threading one strap. One strap adjusting is very quick and easy. Children will love this device as it is very comfortable and doesn't pinch the skin as the parachute-type snap buckles often do. Economically speaking, parents will not necessarily have to buy each child a helmet, since this strap device is "one size fits all". The identification area is invaluable for situations where the helmet is lost, a child is lost or even in cases of emergency.

2 Claims, 7 Drawing Sheets

ADJUSTABLE HELMET STRAPPING DEVICE

BACKGROUND-FIELD OF INVENTION

This invention relates to bicycle helmets and those that are similarly used for safety. Specifically, to a improved multi-function strapping device used to fasten and secure a helmet to the head. Bicycle helmets are very important for safety. Some states require by law children under age 18 to wear a helmet. Often, children and adults do not like to wear helmets because of the discomfort of wearing them. Plus it is difficult to adjust and fasten to the head. A majority of head and facial injuries could be avoided with the use of an optional wearing chin guard along with a secure strapping device that is connected to a helmet. Because of our sports-minded society, a need exists to make an adjustable helmet strap that can also be used for other multi-recreational activities and sports. Humans need an adjustable helmet strap that is safer, quicker to put on, and can be adjusted, without the helmet slipping forwards and/or backwards. Plus there is demand for an apparatus that is structurally sound, made with quality materials, and is comfortable and secure when strapped on. There is also a need for an identification pocket on either the adjustable helmet strap or helmet which provides important personal information. This could be life saving to someone if they had an accident and could not speak, the information would be there. In the case of a lost or missing child, the information would be very valuable to assist the child. Another benefit is the information is useful in finding the proper owner when the helmet gets lost.

BACKGROUND-DISCUSSION OF PRIOR ART

Helmet manufacturers commonly make helmets with a basic configuration of ¾ inch nylon strap(s) that proceeds downward from opposite sides of the helmet and converges underneath the chin. The straps are usually connected by using female and male snap connectors, (see item 6 on FIG. 2. One serious problem with the current strapping device is the tendency to pinch the skin when snapping the female and male connectors together. Another problem is the difficulty in adjusting and establishing a secure fit for children and adults without the helmets sliding back and forth, which creates a safety hazard. Also, whenever someone else wears the helmet, they have the difficult job of readjusting the sliding/adjusting buckle. Furthermore, helmets are being worn improperly because of incorrect adjusting and fit. The design of the snap connectors underneath the chin, bring the inherent problem of choking or the discomfort of the snap buckle against the skin in order to get a correct and secure fit.

OBJECTS AND ADVANTAGES OF MY INVENTION

To provide an adjustable helmet strap which is form fitting to the head.

To provide an adjustable helmet strap which will allow the person to fasten and unfasten it easily and quickly.

To provide an adjustable helmet strap with more stability due to a neck strap that stretches to form fit the head.

To provide a customized fit due to the adjustable helmet strapping device.

To provide an easy way for children to fasten the helmet securely and correctly to the head.

To provide a helmet that is more comfortable to wear when compared to other strapping devices.

To provide an adjustable helmet strap which includes an identification pocket and removable label that allows the person to list his/her name, address, phone and emergency health information.

To provide an adjustable helmet strap which causes the helmet to fit securely to the head.

To provide an adjustable helmet strap that prevents helmet from sliding back and forth on the head.

To provide an adjustable helmet strap that improves protection by using a chin guard.

To provide an adjustable helmet strap that improves when worn.

To provide an adjustable helmet strap which allows flexible sizing.

To provide an adjustable helmet strap which is cost effective to manufacture.

To provide an adjustable helmet strap which is durable and can be used for both adult-size helmets and child/youth-size helmets.

To provide an adjustable helmet strap that can be interchanged and resized instantly without the hassle of adjusting buckles or snaps.

To provide an adjustable helmet strap which allows for a comfortable fit regardless of head shape, head size, or face shape.

To provide an adjustable helmet strap which can be used for other multi-recreational activities and sports, (i.e. in-line skating, roller-hockey, bicycling etc.

To provide an adjustable helmet strap with soft support and protection around the ears.

To provide an adjustable helmet strap which will be used more often due to better comfort and the ease of fastening the helmet to the head.

To provide an adjustable helmet strap which will possible reduce reported and potential head injuries.

To provide an adjustable helmet strap with an optional snap-on chin guard which is adjustable and attaches/detaches to the adjustable helmet strap.

To provide an adjustable helmet strap device with an optional chin guard that utilizes a standard male/female snap connector that allows quick connect and release.

To provide an adjustable helmet strap device that will not pinch when securing the helmet correctly.

To provide an adjustable helmet strap device that is visually attractive and appealing.

To provide an adjustable helmet strap device which is functional.

To provide an adjustable helmet strap device that is easily adaptable to other helmet shell styles and designs.

DESCRIPTION OF DRAWINGS

FIG. 2 also shows a dashed-line circle indicating area shown in detail, (see detail 2).

FIG. 4 also shows a dashed-line circle indicating area shown in detail, (see detail).

Figure 1:
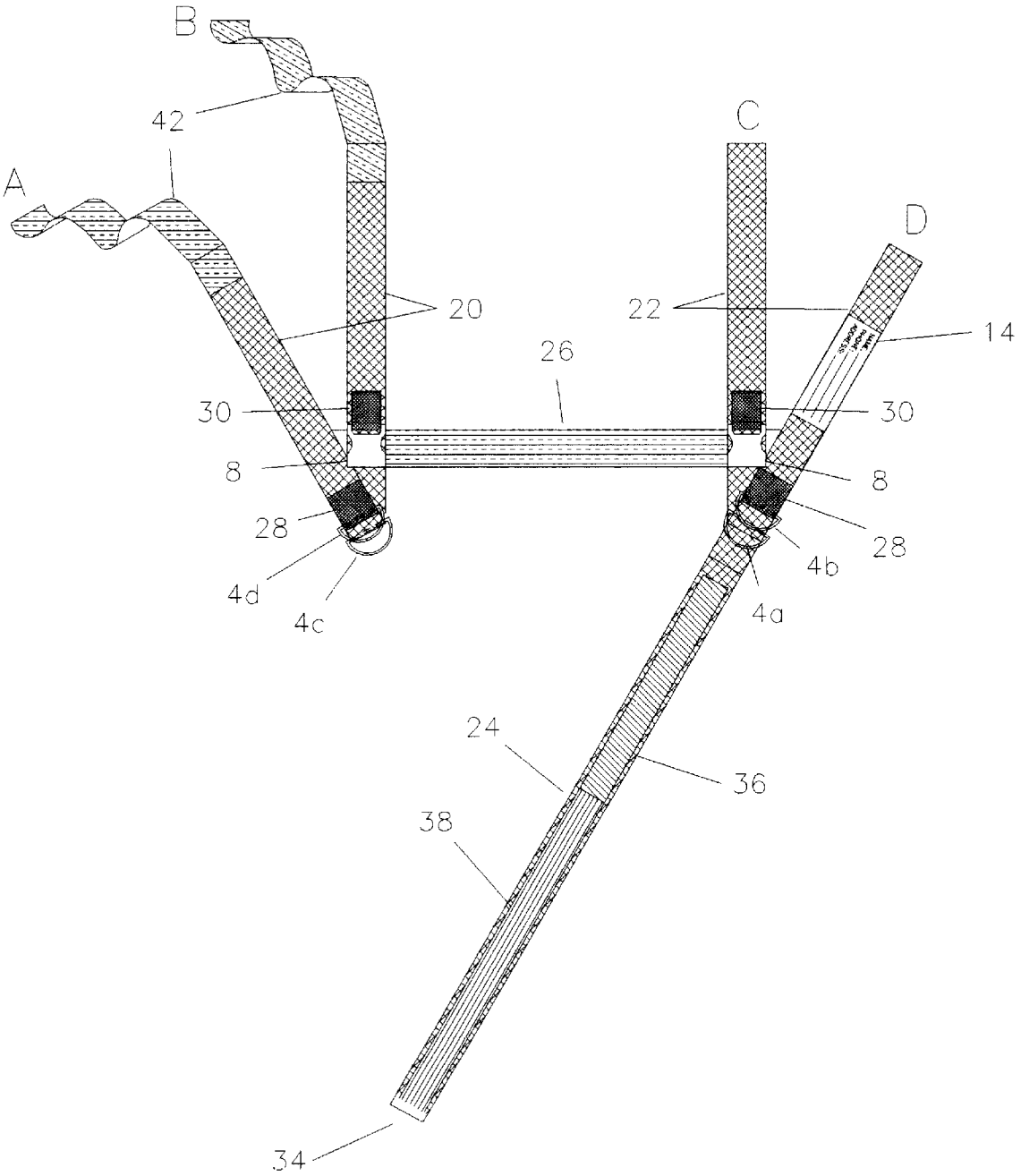
FIG. 1 shows the exterior view of the helmet strapping device, including hardware with each part identified before final attachment to the helmet.

| ITEM # | QTY | DESCRIPTION |
|---|---|---|
| 4a | 1 | 1 inch D-ring (plastic - used for permanent attachment to 24 |
| 4b | 1 | 1 inch D-ring (plastic)** |
| 4c | 1 | 1 inch D-ring (plastic)** |
| 4d | 1 | 1 inch D-ring (plastic)** |
| 6 | 2 | plastic male snap buckle ¾ inch |
| 8 | 2 | plastic female snap buckle ¾ inch |
| 10 | 2 | ¾ inch width plastic sliding adjusting buckle |
| 12 | 1 | chin guard - flexible hard plastic shell outside form-fitting rubber inside, slides to adjust. |
| 14 | 1 | ⅞ inch width & 2¼ inch length clear vinyl pocket with name, address, phone & emergency health information printed on poster board material insert. |
| 20 | 1 | 1" width nylon strap 17 inches in length include 1 inch for attaching the elastic.* |
| 22 | 1 | 1" width nylon strap 17 inches in length include 1 inch for attaching elastic.* |
| 24 | 1 | ¾ inch width nylon strap 18¾ inches in length |
| 26 | 1 | 1 inch width belt elastic 7½ inches in length including ¼ inch seam allowance when sewn to item 44. |

*length may vary depending on helmet size and style.
**D-rings 42b, 42c, & 42d are used in combinations to adjust helmet strap device for exact fit see FIGS. 5–10

| ITEM # | QTY | DESCRIPTION |
|---|---|---|
| 28 | 2 | 1 inch width nylon strap 2 inches in length. |
| 30 | 2 | ¾ inch width nylon strap 3 inches in length |
| 32 | 1 | ¾ inch nylon strap 19 inches in length. Includes 2 inches to allow strap to be threaded through the sliding adjusting buckle, item 10, & sewn. |
| 34 | 1 | ¾ inch width label folded over the end of nylon strap, item 24, and sewn. used as a pull tab |
| 36 | 1 | ¾ inch width hook fastener 7 inches in length |
| 38 | 2 | ¾ inch width loop fastener 10¼ inches in length. |
| 40 | 1 | ¾ inch width hook fastener 5¼ inches in length. |
| 42 | 2 | 1 inch width elastic belt strap*. |
| 44 | 2 | 2½ inch width, 3¼ inches length fleece: folded over & sewn to 1 inch belt elastic, item 26, using ¼ inch seam allowance |
| 46 | 1 | ¾ inch width loop fastener 2-¼ inches in length. |

*length may vary depending on helmet size and style

Referring now to the drawings, wherein like reference numerals designate like or corresponding parts throughout the several views. All capital letters with the exception of the D-rings 4*a,* 4*b,* 4*c* & 4*d* indicate reference points.

Figure 3:
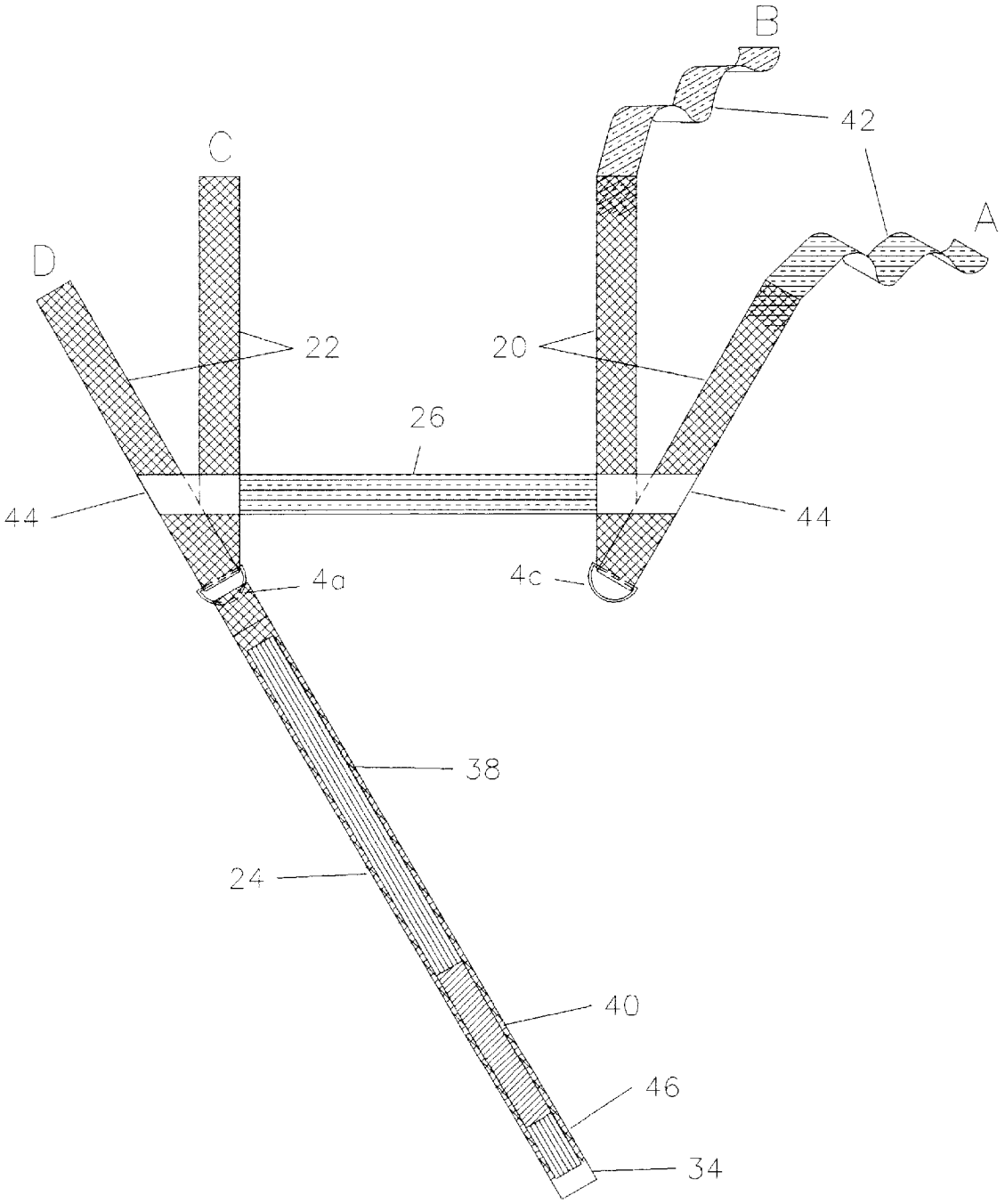
FIG. 3 shows the interior view of the adjustable helmet strapping device, including hardware with each part identified before final attachment to the helmet.
Figure 11:
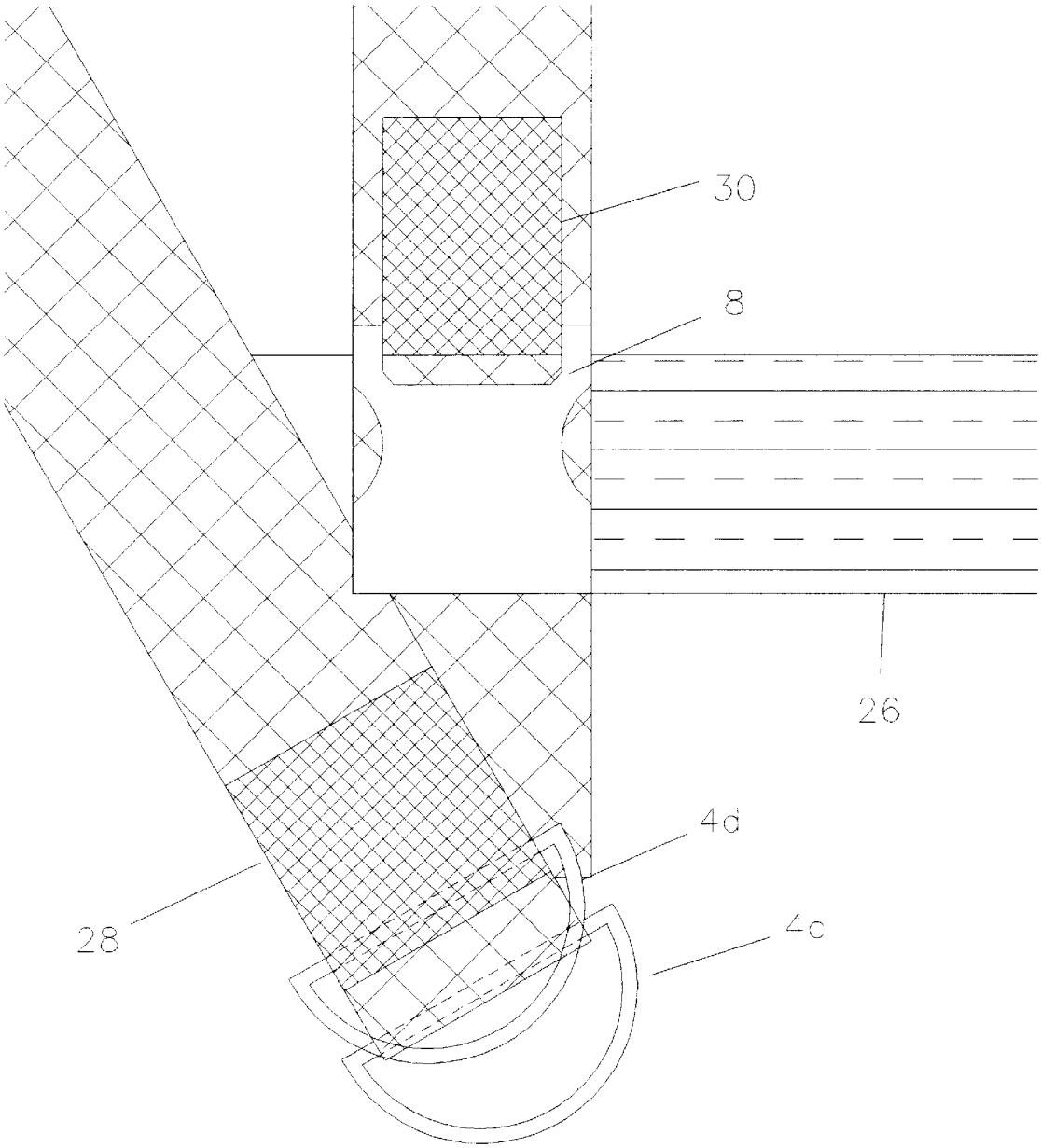
FIG. 11 shows a close-up detail of the area where strap meets elastic belt strap, and the position of the attached D-rings and female snap buckle.

FIGS. 1, 3 & 11 Left side of strapping device

Shows the provision of a strapping device that can be attached to a protective helmet. The strapping system comprises of left and right retention straps 20 and 22 respectively. Strap 20, comprises of 1" wide nylon strap approximately 17" in length which is attached on both ends to 1" wide elastic 42, the length of elastic will vary due to different helmet sizes. Approximately 3" down from Reference point B on strap 20 the female snap buckle 8 is attached using ¾" nylon strap 3" inches in length. Refer to FIG. 11 for enlarged view of area. Strap 20 extends down from the helmet about 5" where it folds up toward the helmet at approximately a 45 degree angle. Where strap 20 folds is where the first D-ring 4*c* is attached by sewing or riveting the strap 20 together at the point where they converge. The second D-ring 4*d* is positioned 1" directly above D-ring 4*c* and attached with 1" wide nylon strap 28 which is 2" in length. 1" up toward the helmet on strap 20 reference point B, elastic belt strap 26 is positioned horizontally at a 90 degree angle to strap 20 reference point B & strap 22 reference point C. Note FIG. 3 shows the back side of FIG. 1 which better illustrates how the soft fleece 44 is positioned on elastic belt 26 by folding 44 over and attaching it to 26.

FIGS. 1 & 3 Right side of strapping device

Strap 22 consists of 1" wide nylon strap 17" in length. Approximately 3" down from where 22 meets the helmet, is the clear vinyl pocket 14 that is used for owner identification. It is attached in a centered position on 22. Where strap 22 bends is where the first D-ring 4*a* is attached by sewing or riveting the strap 22 together at the point where they converge. The second D-ring 4*b* is positioned directly above D-ring 4*a* and attached with 1" wide nylon strap 28 which is 2" in length. Approximately 1" up from where 22 bends reference point C is where the 1" width belt elastic 26 is positioned horizontally for 7½" connecting strap 22 with strap 20. Note FIG. 3 shows the back side of FIG. 1 which better illustrates how the soft fleece 44 is positioned on elastic belt 26 by folding 44 over and sewing it to 26.

FIG. 1 Chin Strap Assembly

Strap 24 consists of ¾" nylon strap 18 ¾" in length. Strap 24 is attached to the D-ring 4*a* by threading 24 through D-ring 4*a* and back onto 24 where it is overlapping for 1" and is stitched together. Arranged 1½" down on 24 is ¾" wide & 7" in length hook fastener 36 which is placed on the surface of strap 24 and stitched together. At the position where 36 ends on strap 24 is where ¾" width loop fastener 10 ¼" in length is arranged on the surface of strap 24 and stitched. In order to facilitate ease of strap removal, attached to the lowest extent of strap 24 is ¾" width label 34 which is folded over the end of 24 & stitched together.

FIG. 3 Chin Strap Assembly

In FIG. 3 the opposite side of the strapping device is shown which indicates placement of items 38, 40, 46, & 34 of the chin strap assembly and how it's connected to D-ring 4*a*. Positioned 1½" down strap 24 from D-ring 4*a*, ¾" width loop fastener 38 10 ¼" length is attached to the surface of strap 24 by stitching. At the position where 38 ends on strap 24 is where ¾" width hook fastener 30 5¼" in length is arranged on the surface of strap 24 and stitched. At the position where 40 ends on strap 24 is where ¾" width loop fastener 46 2¼" in length is arranged on the surface of strap 24 and stitched.

Figure 2:
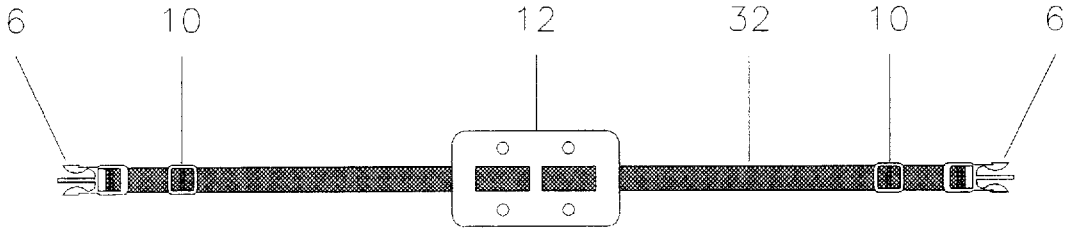
FIG. 2 shows the chin guard assembled including hardware with each part identified before attachment to the adjustable helmet strapping device.
Figure 4:
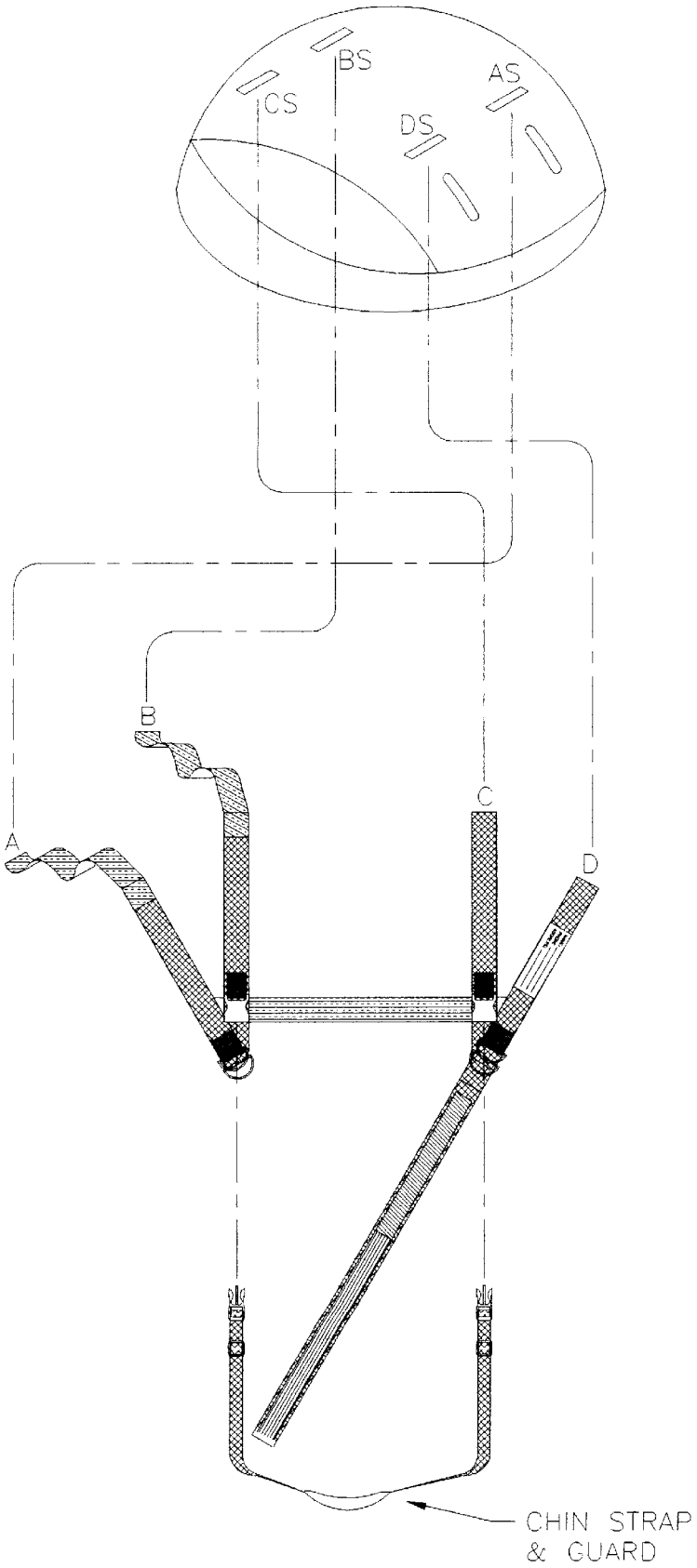
FIG. 4 shows the exterior view of the adjustable helmet strapping device and basic assembly for achieving final attachment to a helmet. It also maps reference points A, B, C and D to helmet slots AS, BS, CS and DS allowing manufacturer to assemble and clamp the straps before outer helmet shell it attached.
Figure 12:
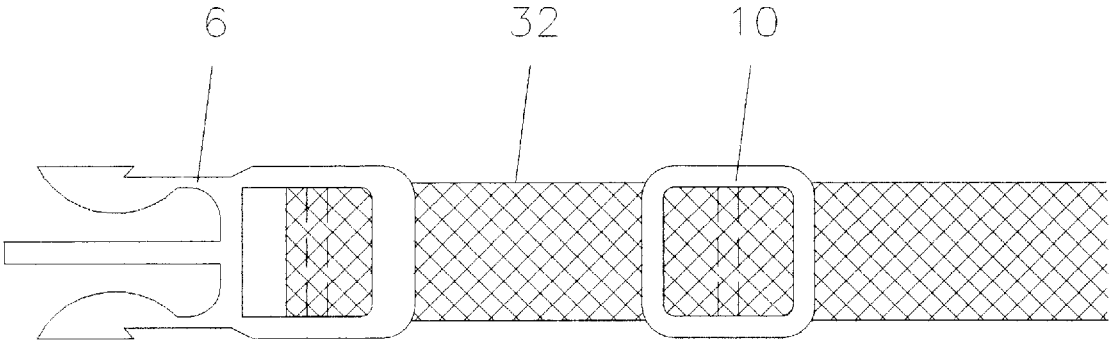
FIG. 12 shows a close-up detail of the chin guard strap and how the strap is threaded through the hardware.

FIGS. 2, 4 & FIG. 12 Chin Guard Assembly

Shows the provision of the chin guard assembly which comprises of one plastic male snap buckle 6 attached to both ends of ¾" nylon strap 32 19" in length. Refer to FIG. 12 for an enlarged view of one extent of the chin guard assembly. ¾" wide plastic slide adjusting buckle 10 is attached to strap 32 by looping 32 around the center post of 10 and back onto 32 so it overlaps 32 for a length of about 1½" & is stitched together allowing enough space to facilitate rotation on the center post. The opposite extent of strap 32 is threaded underneath the first opening up through the second opening on 6 and then down through the first opening toward 10. Strap 32 is threaded through 10 by traveling up through the first opening of 10 and over the center post and down through the second opening of 10 toward the chin guard 12. Strap 32 is threaded through 12 by traveling underneath the first post, up through the opening, over the top of the second post, down underneath the third post, up through the opening, over the top of the fourth post, and down underneath the fifth post.

Referring to FIG. 4, attachment of the chin guard 12 to the adjustable helmet strapping device is accomplished by matching up the male snap buckle 6 to the opening of female snap buckle 8, thus inserting 6 into 8 until the notches on the male snap buckle click into place inside the female snap buckle.

FIG. 4 Attachment of Strapping Device to Protective Helmet

In connection with the manufacturing of the protective helmet; the design of the helmet would provide 4 open slots allowing attachment of strap 20 to strap 22. In order to provide maximum protection to the wearer, the straps would be attached to the protective helmet before the hard shell outer housing is attached. Referring to FIG. 4, note on the last 1" of each extent of strap 20 is attached to the 1" width elastic belt strap 42 by stitching together. The length of 42 will vary depending on actual helmet size to ensure a snug fit to the wearer. Strap 42 reference point A is threaded up through the opening in the foam core reference point AS of the helmet and positioned over the top of the helmet. Strap 22 reference point D is threaded up through the opening in the foam core reference point DS of the helmet and placed on top strap 42 reference point A whereby it stitched together in a fashion that allows proper positioning of the lower straps to the wearer. Strap 42 reference point B is threaded up through the opening in the foam core reference point BS of the helmet and positioned over the top of the helmet. Strap 22 reference point C is threaded up through the opening in the foam core reference point CS of the helmet and placed on top strap 42 reference point B whereby it stitched together in a fashion that allows proper positioning of the lower straps to the wearer. The advantage of using elastic belt straps 42 is that it guarantees a comfortable, snug fit to the wearer regardless of head size.

FIGS. 5 through 10 Attachment of Helmet to Head

Figure 5:
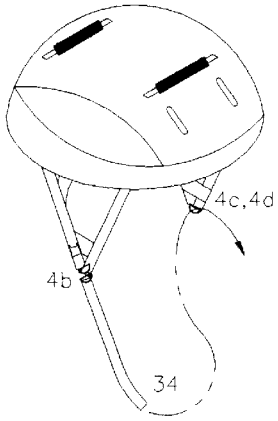
FIGS. 5 to 10 shows a sequence of diagrams illustrating how the adjustable helmet strapping device is threaded, adjusted and fastened.
Figure 6:
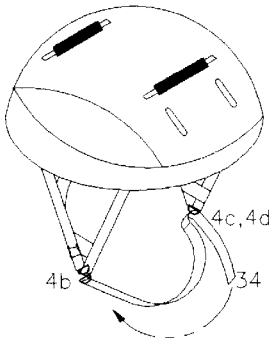
Figure 7:
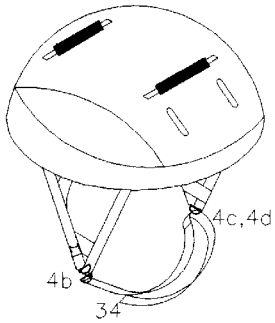
Figure 8:
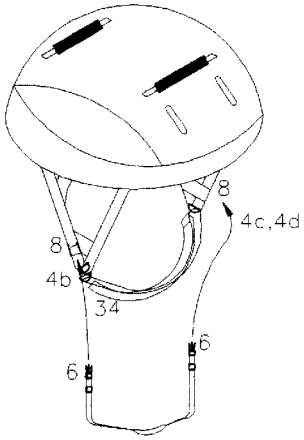
Figure 9:
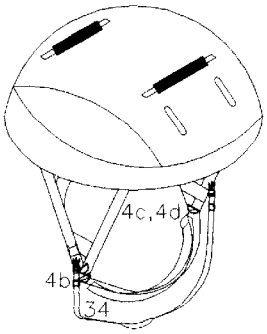
Figure 10:
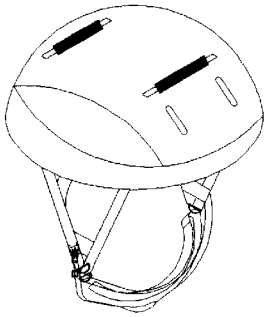

In order to obtain substantial protection the helmet must be placed firmly on the head of the wearer and cover the forehead and back of head. As indicated in FIGS. 5 & 6 strap 34 is threaded through D-ring 4*c* or 4*d* depending on the wearers head size. Strap 34 is pulled back across underneath the chin until the strap is tight as shown in FIG. 7. In cases where the head size is smaller as in a child, the D-ring 4*b* can be used to take up excess slack of strap 34. Likewise if there is sufficient slack remaining after threading 34 through D-ring 4*b*, strap 34 can be threaded back through D-ring 4*d*.

I claim:

1. An adjustable helmet strapping device for attaching a helmet to a human head comprising:

a first strap adapted to extend from a first rear quadrant of the helmet and having a proximal end and a distal end;

a second strap adapted to extend from a second rear quadrant of the helmet and having a proximal end and a distal end;

a first and second straps being interconnected by an elastic belt adapted to extend about the rear portion of a wearer's head;

a third strap adapted to extend from a first front quadrant of the helmet and having a proximal end and a distal end, the third strap distal end being attached to the first strap adjacent its distal end;

a fourth strap adapted to extend from a second front quadrant of the helmet and having a proximal end and a distal end, the fourth strap distal end being attached to the second strap adjacent its distal end;

a fifth strap connected via a plurality of D-rings to the distal ends of the first, second, third and fourth straps and adapted to extend beneath a wearer's chin;

a chin strap and guard attached via snap buckles to the first and second straps and adapted to extend beneath a wearer's chin, the chin guard comprising an energy absorbing material.

2. The strapping device of claim 1, and further comprising, a clear vinyl pocket with name, address, phone number and emergency health information printed on firm paper within the pocket.

* * * * *